United States Patent [19]

Overmyer et al.

[11] 3,930,641

[45] Jan. 6, 1976

[54] FURNACE HOOD STRUCTURE

[75] Inventors: Robert C. Overmyer; Billy M. Brumett, both of Indianapolis, Ind.

[73] Assignee: Hawley Manufacturing Corporation, Indianapolis, Ind.

[22] Filed: Sept. 12, 1974

[21] Appl. No.: 505,235

[52] U.S. Cl. ..... 266/16; 98/115 R

[51] Int. Cl.[2] ..... C21C 5/38

[58] Field of Search ..... 98/115 R, 115 FV; 266/33 R, 15–17, 19

[56] References Cited

UNITED STATES PATENTS 3,756,582 9/1973 Overmyer et al. ..... 266/15

*Primary Examiner*—Gerald A. Dost

*Attorney, Agent, or Firm*—Jenkins, Hanley & Coffey

[57] ABSTRACT

In a combination of a furnace which is provided with an upwardly opening mouth, a lid for the mouth, a hood associated with the furnace and enclosing the mouth, the hood having a ceiling disposed above the uppermost position of the lid and the ceiling being formed with a port registering with the furnace mouth, and a cover for the port, the improvement in which the lid is supported upon a generally vertically upwardly extending post for swinging movement with the post about a substantially vertical axis outside the boundary of the mouth between a position in registry with the mouth and a position laterally removed from such registry, and the cover being mounted upon the post for swinging movement about the axis with the post and the lid.

5 Claims, 2 Drawing Figures

FURNACE HOOD STRUCTURE

Figure 1:
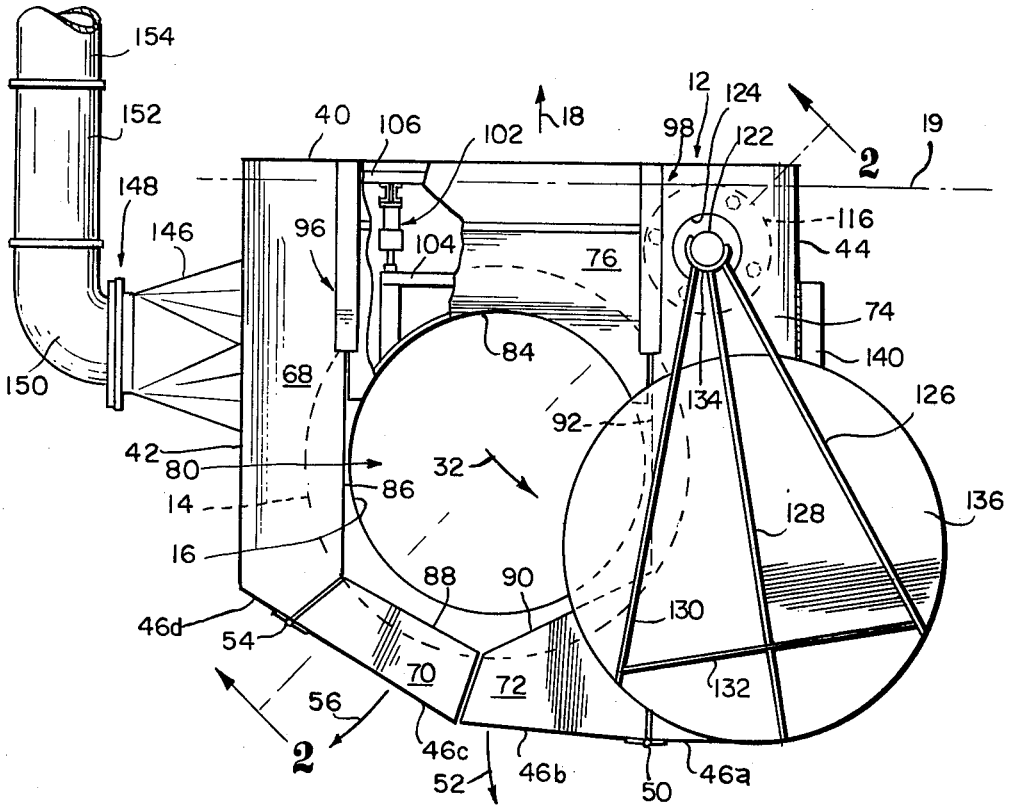

The present invention relates to a fumes-controlling hood primarily intended for use upon or associated with a metal-melting furnace of the type having an upwardly opening charging mouth equipped with a lid which is mounted to swing about a substantially vertical axis outside the boundary of the mouth, between a position in registry with the furnace mouth and a position laterally displaced from such registry. Charges of material to be melted are introduced to the furnace through the mouth by means of charging buckets of known construction, such buckets being provided with a valved bottom which is swung into registry with the furnace mouth at times when the lid is in its laterally displaced position. The bucket valve is operated to dump the charge into the furnace.

Whenever the furnace mouth is open, and particularly when material to be melted is charged into the furnace or when molten material is being poured, heavy, noxious fumes arise from the furnace into the atmosphere surrounding the furnace. The resultant pollution of the working environment cannot be tolerated under laws and rules controlling such environments.

Reference is made to the Robert C. Overmyer and John Scheel U.S. Pat. No. 3,756,582 issued Sep. 4, 1973 and the patent references cited therein including U.S. Pat. Nos. 2,908,737; 2,377,597; 3,415,179; and 2,268,918.

The Overmyer and Scheel U.S. Pat. No. 3,756,582 discloses a metal melting furnace of the type with which the present invention is involved and particularly the mouth and lid structure of such furnaces. In the U.S. Pat. No. 3,756,582, the lid carries a driver which, when raised, engages the cover for an opening in the hood above the furnace to move the cover laterally out of the way when the lid itself is being moved laterally out of the way. In other words, an upwardly extending driver provides a driving connection between the furnace lid and the cover of the hood port above the lid. The cover and the lid are removed so that a charging bucket can be lowered downwardly into registry with the furnace mouth and through the port in the hood to charge the furnace with material to be melted.

The hood and furnace combination of the present invention constitutes an improvement over the prior art because the means for supporting the lid for swinging movement is also adapted to be the means for supporting the hood port cover for swinging movement.

It is a primary object of the present invention, therefore, to provide, in a combination of a furnace which is provided with an upwardly open mouth, a lid for the mouth and means supporting the lid to swing, about a substantially vertical axis outside the boundary of the mouth, between a position in registry with the mouth and a position laterally removed from such registry, a hood associated with the furnace and enclosing the mouth, the hood having a ceiling disposed above the uppermost position of the lid and the ceiling being formed with a port registering with the furnace mouth, and a cover for the port, the improvement in which the means for supporting the lid includes a generally vertically upwardly extending post upon which the lid is mounted, and the cover being mounted upon the post for swinging movement about the said vertical axis with the post and the lid.

Another object is to provide such an improvement in which the post has an upper portion extending upwardly through an aperture in the ceiling of the hood, the rigid support arms extending radially outwardly from the upper portion and above the ceiling of the hood, the cover being rigidly attached to the support arms for movement therewith. In some cases, it may be preferable to have the entire post structure outside the hood. Preferably, the said upper post portion is removably fastened to the portion of the post upon which the lid is mounted such that the hood and cover and post upper portion can be removed from the furnace as an assembly.

Other objects and features of the present invention will become apparent as this description progresses.

To the accomplishment of the above and related objects, this invention may be embodied in the form illustrated in the accompanying drawings, attention being called to the fact, however, that the drawings are illustrative only, and that changes may be made in the specific construction illustrated and described, so long as the scope of the appended claims is not violated.

Figure 2:
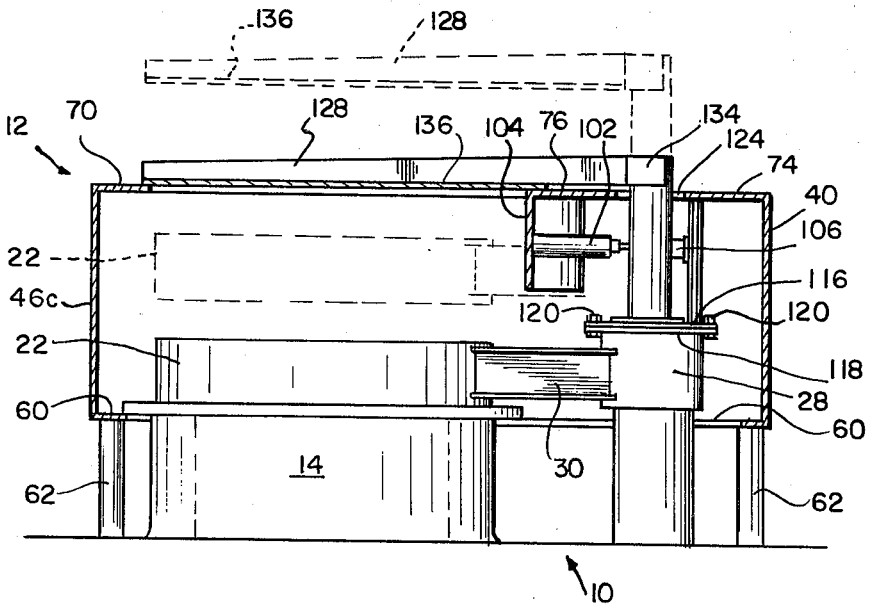

In the drawings:

FIG. 1 is a plan view of the hood and furnace showing the lid and the hood cover moved to their open position; and, FIG. 2 is a sectional elevational view taken generally along the line 2—2 in FIG. 1.

Referring now particularly to the drawings, it will be seen that the combination comprises a furnace 10 and hood 12 and that we have illustrated the upper portion 14 of a conventional furnace having an upwardly opening mouth 16 through which the furnace is charged. The type of furnace with which the present invention is usable is disclosed in the said U.S. Pat. No. 3,756,582. Such a furnace is mounted for tilting movement about a generally horizontally extending pivot axis to pour the molten metal therefrom. In FIG. 1, we show an arrow 18 indicating the direction in which the furnace is tilted and in which the metal is poured from a spout (not shown). In FIG. 1 also, we show a centerline representation of the tilt axis indicated at 19.

Such a furnace 10 is conventionally designed so that its mouth 16 is closed by a large, heavy lid 22 which is generally circular and a portion of which seats downwardly in the mouth 16. Such a lid is conventionally mounted on a generally vertically extending post indicated at 28 by means of heavy beam support such as indicated at 30. Conventional means (not shown) is provided for moving the post axially upwardly to lift the lid and then to rotate the post about its axis to move the lid counterclockwise (arrow 32) as viewed in FIG. 1.

The hood 12 is mounted on and above the furnace 10 to provide means for capturing the fumes arising from the furnace and preventing the fumes from emanating into the environmental atmosphere. The hood 12 operates in conjunction with an exhaust system of the type discussed in U.S. Pat. No. 3,756,582 which draws the fumes from the hood and carries them away for suitable disposition. It is our concept to draw a high-velocity stream of environmental air into and through the hood to entrain any fumes arising from the furnace and to carry such fumes to a position away from the workmen.

In the illustrative embodiment, the hood 12 includes a front wall 40, side walls 42, 44 and back wall segments **46*a*, 46*b*, 46*c* and 46*d*. The back wall segment 46*b* is hinged to the segment 46*a* by means of a vertically extending hinge 50 for movement as indicated by the arrow 52. Similarly, the segment 46***c* is hinged to the segment 46*d* by the vertically extending hinge 54 for movement as indicated by the arrow 56. These two segments 46*b*, 46*c*, therefore, can be swung outwardly away from the furnace mouth 16 to give the workmen access to that mouth when needed. The hood 12 also provides a floor 60 the inner perimeter of which may or may not be closely adjacent the outer perimeter of the upper portion 14 of the furnace 10 as desired. Additionally, legs 62 support the outer portions of the hood 12 upon the floor.

The hood 12 has a ceiling which lies generally in a horizontally extending plane and which, in the illustrative embodiment, includes ceiling panels 68, 70, 72, 74 and 76. It will be appreciated that the ceiling panels 70, 72 are attached to and movable with the panels 46*c*, 46*b*, respectively. The ceiling of the hood 12 is well above the maximum height or position of the lid 22 of the furnace. The ceiling provides a port 80 which is in registry with the mouth 16 of the furnace, the illustrative port 80 being defined primarily by the curved edge 84 of the ceiling panel 76 and the straight edges 86, 88, 90, 92, respectively, of the ceiling panels 68, 70, 72, 74.

In addition, slide means 96, 98 are provided for mounting the ceiling panel 76 for movement in the direction of the arrow 18 toward and away from the center axis of the mouth 16. Preferably, shock absorber means is provided for yieldably resisting movement of the ceiling panel 76 by, for instance, the charging bucket, and in the illustrative embodiment two such linear acting shock absorbers 102 resist movement of the panel 76. In FIG. 1, we show only one of the shock absorbers 102 connected between a brace or bumper plate 104 on the panel 76 and a brace 106 on the wall 40. The brace 104 extends laterally across the ceiling panel 76 generally perpendicular to the direction of movement of the panel and this brace 104 has a downwardly extending flange as best seen in FIG. 2 against which the charging bucket may be slammed.

We provide a circular mounting plate 116 which is mounted upon a similar plate 118 secured to the post 28 and removably fastened thereto by means such as the illustrated fastening elements 120. Then, in order to provide an upper portion for the post, we weld or otherwise securely attach a heavy steel pipe 122 to the plate 116 to extend vertically upwardly coaxially with the post 28. This upper post portion 122 extends upwardly through an aperture 124 in the ceiling panel 74. In some cases, the upper post portion 122 may be disposed outside the hood. Then, radially outwardly extending support arms 126, 128, 130 are provided with the distal end portions of the arms being connected together by a brace 132 and the proximal end portions of the arms being welded or otherwise securely fastened to a ring portion 134 which is welded or otherwise securely attached to the post upper portion 122 as shown. Then, a circular plate 136 is rigidly attached to the supporting arms to provide a cover for the port 84. This cover 136 moves up and down with the lid 22 when the post 28 is raised and lowered as indicated in FIG. 2. Further, the cover 136 swings with the lid 22 as the post moves about its axis as shown in FIG. 1.

The side wall 44 is provided with a horizontally elongated opening covered by a flap or door 140 hinged to the side wall. When the lid 22 moves in the direction of the arrow 32 in FIG. 1, the lid itself pushes the door 140 upwardly about its hinge axis so that the lid can protrude through the opening in the side wall.

The side wall 42 has an opening therein in communication with an outwardly extending duct 146 as shown in FIG. 1. A swivel connection 148 is provided between the outwardly extending duct 146 and an elbow duct 150 which leads to the telescoping sections 152, 154 of an exhaust vent system. When the furnace 10 tilts about the horizontal axis, the swivel connection 148 and telescoping duct sections 152, 154 accommodate the movement of the hood 12 with the furnace.

We claim:

1. In a combination of a furnace which is provided with an upwardly opening mouth, a lid for said mouth and means supporting said lid to swing about a substantially vertical axis outside the boundary of said mouth between a position in registry with said mouth and a position laterally removed from such registry, a hood associated with said furnace and enclosing said mouth, said hood having a ceiling disposed above the uppermost position of said lid and said ceiling being formed with a port registering with said furnace mouth, and a cover for said port, the improvement in which said means for supporting said lid includes a generally vertically upwardly extending post upon which said lid is mounted, said post defining said axis, and said cover being mounted upon said post for upward movement as said post is projected axially upwardly and for swinging movement about said axis with said post and said lid, said cover being supported by said post when said post is projected axially upwardly.

2. The improvement of claim 1 in which said ceiling is provided with an aperture spaced apart from said port and in vertical registry with said post, said post having an upper portion extending upwardly through said aperture, said cover being connected to said upper portion.

3. The improvement of claim 1 in which said post provides an upper portion extending upwardly through an aperture in said ceiling, and rigid support arms extending radially outwardly from said upper portion and above said ceiling, said cover being rigidly attached to said support arms for movement therewith.

4. The invention of claim 3 in which said post upper portion is removably fastened to the portion of said post upon which said lid is mounted such that said hood and cover and post upper portion can be removed from said furnace as an assembly.

5. The invention of claim 2 in which said post upper portion is removably fastened to the portion of said post upon which said lid is mounted such that said hood and cover and post upper portion can be removed from said furnace as an assembly.

* * * * *